US006739828B2

(12) United States Patent
Schneider

(10) Patent No.: US 6,739,828 B2
(45) Date of Patent: May 25, 2004

(54) PUMP HAVING MULTIPLE VOLUTE PASSAGES AND METHOD OF PUMPING FLUID

(75) Inventor: Marvin P. Schneider, East Peoria, IL (US)

(73) Assignee: Caterpillar Inc, Peoria, IL (US)

( * ) Notice: Subject to any disclaimer, the term of this patent is extended or adjusted under 35 U.S.C. 154(b) by 49 days.

(21) Appl. No.: 10/167,112

(22) Filed: Jun. 11, 2002

(65) Prior Publication Data

US 2003/0091434 A1 May 15, 2003

Related U.S. Application Data

(60) Provisional application No. 60/349,997, filed on Nov. 9, 2001.

(51) Int. Cl.[7] ..... F04D 29/42
(52) U.S. Cl. ..... 415/1; 415/206
(58) Field of Search ..... 415/202, 203, 415/204, 205, 206, 1

(56) References Cited

U.S. PATENT DOCUMENTS

| | | | | |
|---|---|---|---|---|
| 2,444,644 A | | 7/1948 | Fullemann | |
| 2,981,516 A | | 4/1961 | Egli | |
| 3,292,364 A | | 12/1966 | Cazier | |
| 3,380,711 A | | 4/1968 | Blattner et al. | |
| 3,383,092 A | * | 5/1968 | Cazier | 415/186 |
| 3,494,704 A | | 2/1970 | Culaud et al. | |
| 3,785,128 A | | 1/1974 | Redemann | |
| 3,941,104 A | | 3/1976 | Egli | |
| 4,025,228 A | | 5/1977 | Lieber | |
| 4,383,800 A | * | 5/1983 | Becker et al. | 415/204 |
| 4,544,326 A | | 10/1985 | Nishiguchi et al. | |
| 4,789,301 A | | 12/1988 | Osborne et al. | |
| 5,624,229 A | | 4/1997 | Kotzur et al. | |

* cited by examiner

*Primary Examiner*—Edward K. Look
*Assistant Examiner*—Dwayne J. White
(74) *Attorney, Agent, or Firm*—Larry G Cain

(57) ABSTRACT

A pump includes a pump housing having an impeller recess therein and a pump outlet and an impeller disposed in the impeller recess. First and second separate volute passages are disposed in the pump housing and are further disposed in fluid communication between the impeller recess and the pump outlet. Motive power and fluid are supplied to the impeller recess, thereby inducing fluid flow therein. The fluid flow is divided into the separate volute passages and the divided flow is recombined in a convergence passage before exiting the pump outlet.

17 Claims, 22 Drawing Sheets

PUMP HAVING MULTIPLE VOLUTE PASSAGES AND METHOD OF PUMPING FLUID

This application claims the benefit of prior provisional patent application Serial No. 60/349,997 filed Nov. 9, 2001.

TECHNICAL FIELD

The present invention relates generally to pumps, and more particularly to a pump driven by an engine.

BACKGROUND

Internal combustion engines utilize one or more fluid pumps that circulate cooling fluid in cooling passages. Often, these pumps are gear-driven for reliability. In recent years, the ratings of engines have been increased, leading to the need for increased pump capacity so that adequate cooling can be accomplished. This increased capacity can be achieved by increasing the driving speed of the pump and/or increasing pump size.

The location and diameter of the pump driving gear, together with the diameter of the driven pump gear, determine the possible mounting location(s) of the pump along the arc of the driving gear. Efforts to increase pump capacity by increasing the gear-driven speed of the pump have proved problematic, in that the space available for the pump is extremely limited. Specifically, pump speed can be increased through a reduction in the diameter of the driven pump gear. However, such a solution requires the pump to be moved toward the engine block to maintain the gear mesh. In some installations, the engine block or other engine components may interfere with the pump body to an extent that such a design solution is not possible.

Centrifugal pumps with radial volutes have been manufactured for many years. An axial volute scroll pump is utilized on a tractor engine manufactured and sold by John Deere under part number RE53538.

In addition, turbochargers have been designed having a divided housing for a turbine. See, for example, U.S. Pat. Nos. 2,444,644 and 3,941,104 and other patents cited during the prosecution of the latter patent. These types of housings have multiple inlets that receive exhaust gases from separate engine cylinders, multiple volute passages that converge into a single main turbine recess and a single outlet. The multiple inlets and volute passages permit the extraction of energy from the exhaust gas flow paths from the cylinders.

The present invention is directed to overcoming one or more of the problems or disadvantages associated with the prior art.

SUMMARY OF THE INVENTION

In accordance with one aspect of the present invention, a pump includes a pump housing having an impeller recess therein and a pump outlet. An impeller is disposed in the impeller recess and first and second separate volute passages are disposed in the pump housing in fluid communication between the impeller recess and the pump outlet.

In accordance with a further aspect of the present invention, an engine system includes an engine and a pump operatively coupled to the engine, wherein the pump includes a housing having an impeller recess therein and a pump outlet. An impeller is disposed in the impeller recess and first and second separate volute passages are disposed in the pump housing in fluid communication between the impeller recess and the pump outlet.

In accordance with yet another aspect of the present invention, a method of pumping fluid comprises the steps of providing a pump having a housing wherein the pump housing includes an impeller recess having an impeller therein and a pump outlet and supplying fluid to the impeller recess and motive power to the impeller thereby to induce fluid flow in the impeller recess. The fluid flow is divided into first and second separate flows in the pump housing and the fluid flows are recombined in a convergence passage in the pump housing adjacent the pump outlet.

DETAILED DESCRIPTION

Figure 1:
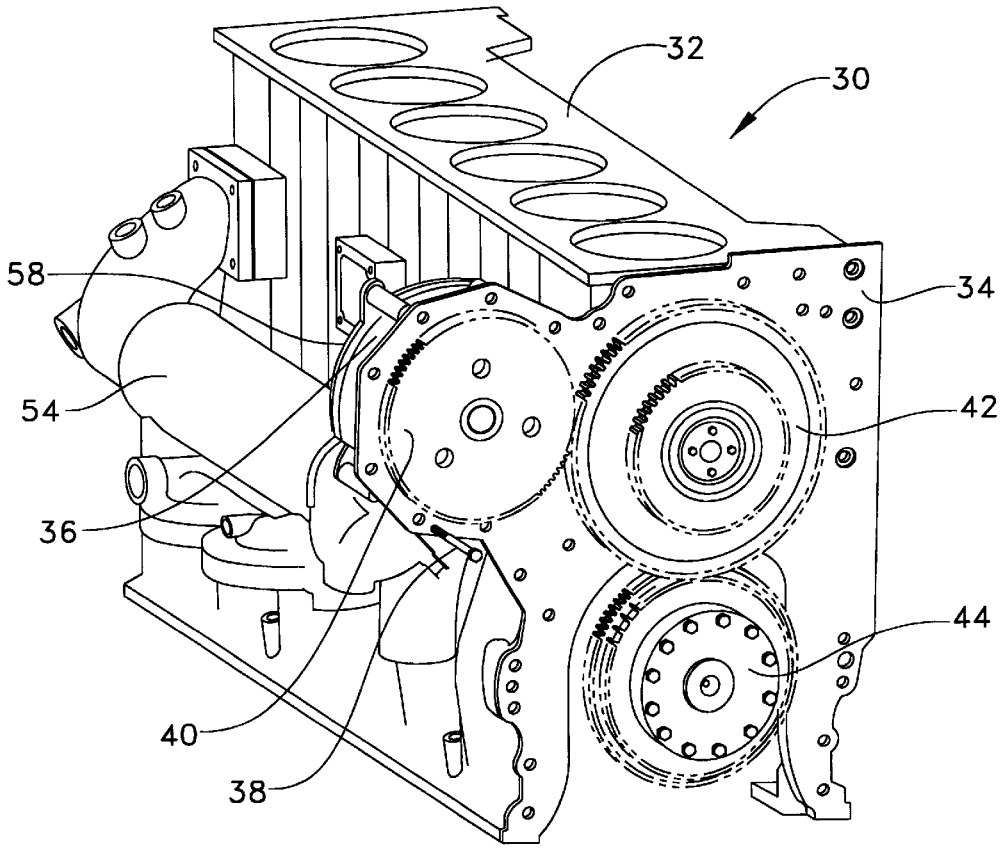
FIG. 1 is a fragmentary and partially exploded front trimetric view of an engine having an engine cover removed to reveal a pump according to one aspect of the present invention.
Figure 2:
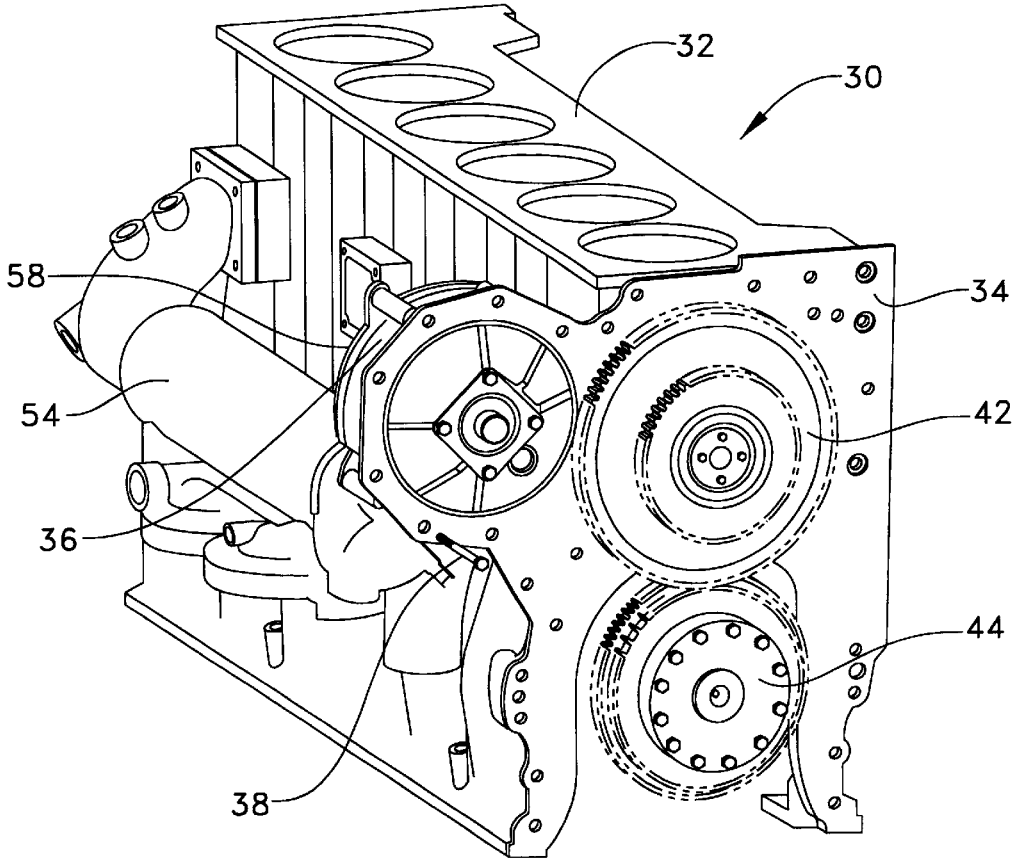
FIG. 2 is a trimetric view similar to FIG. 1 with pump gearing removed.

Referring to FIGS. 1–4 a portion of an internal combustion engine 30 is shown. The engine 30 includes an engine block 32, an end plate 34 secured to the engine block 32 and a pump 36 according to the present invention secured to the end plate 34 by bolts 38 (one of which is shown in the FIGS.). The pump 36 includes a pump gear 40 which is engaged by and driven by a journaled engine driving gear 42. The driving gear 42 is, in turn, driven by a crankshaft gear 44. While the pump 36 is adapted to supply coolant under pressure to the engine 30, it should be noted that the pump 36 may instead be adapted to pump any other fluid and/or may be associated with and/or driven by a prime mover other than the engine 30, as desired.

Figure 3:
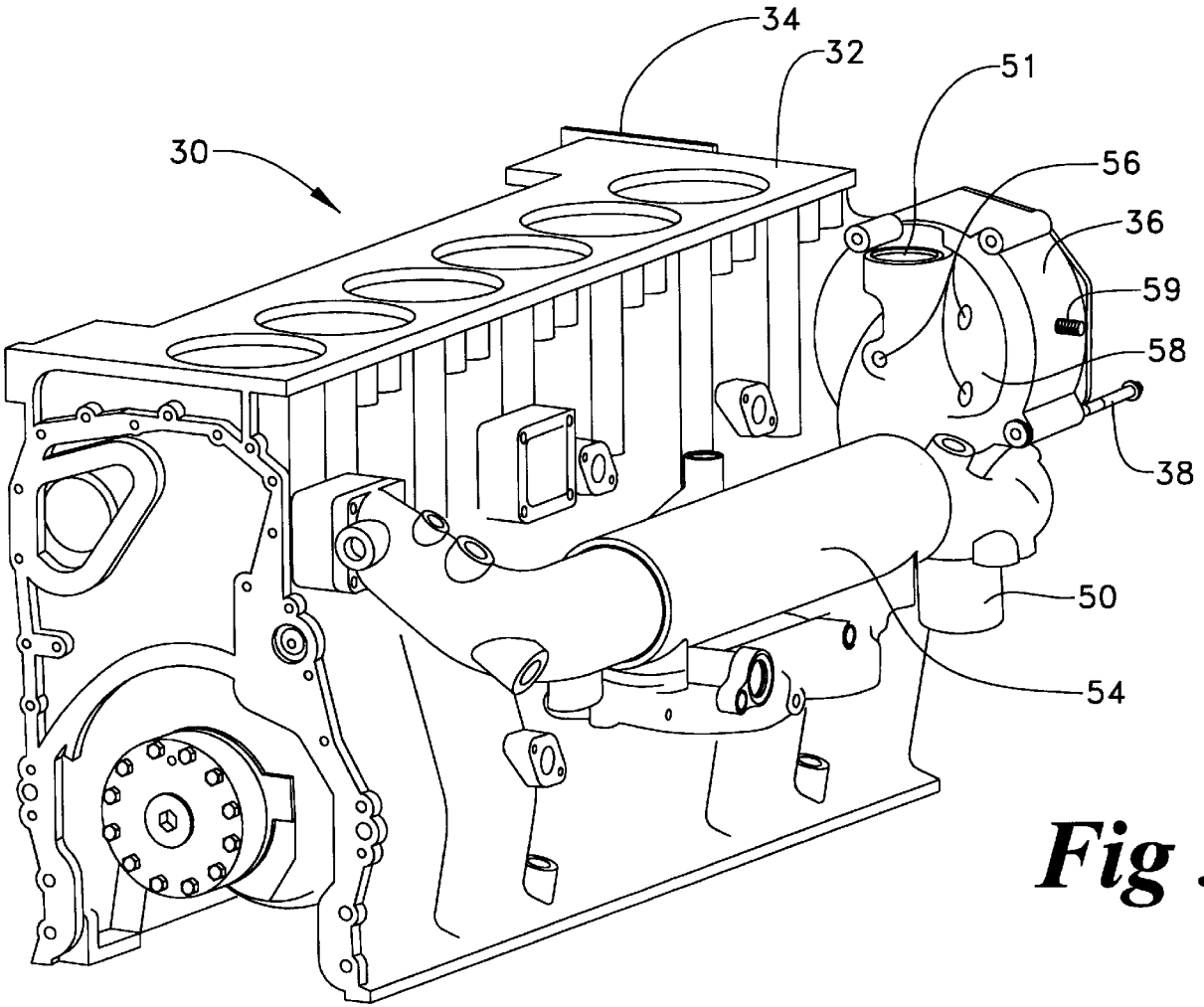
FIG. 3 is a fragmentary and partially exploded rear trimetric view of the engine of FIG. 1.
Figure 4:
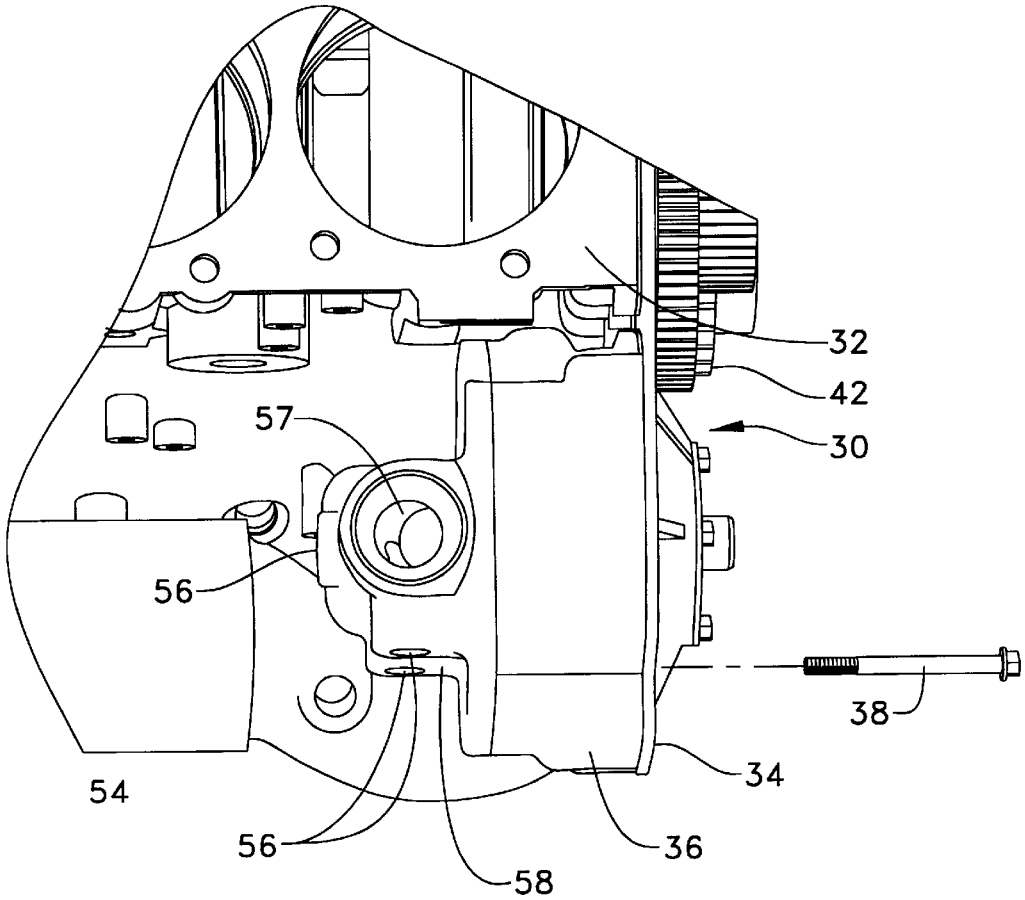
FIG. 4 is a plan view of the pump of FIG. 1.
Figure 8:
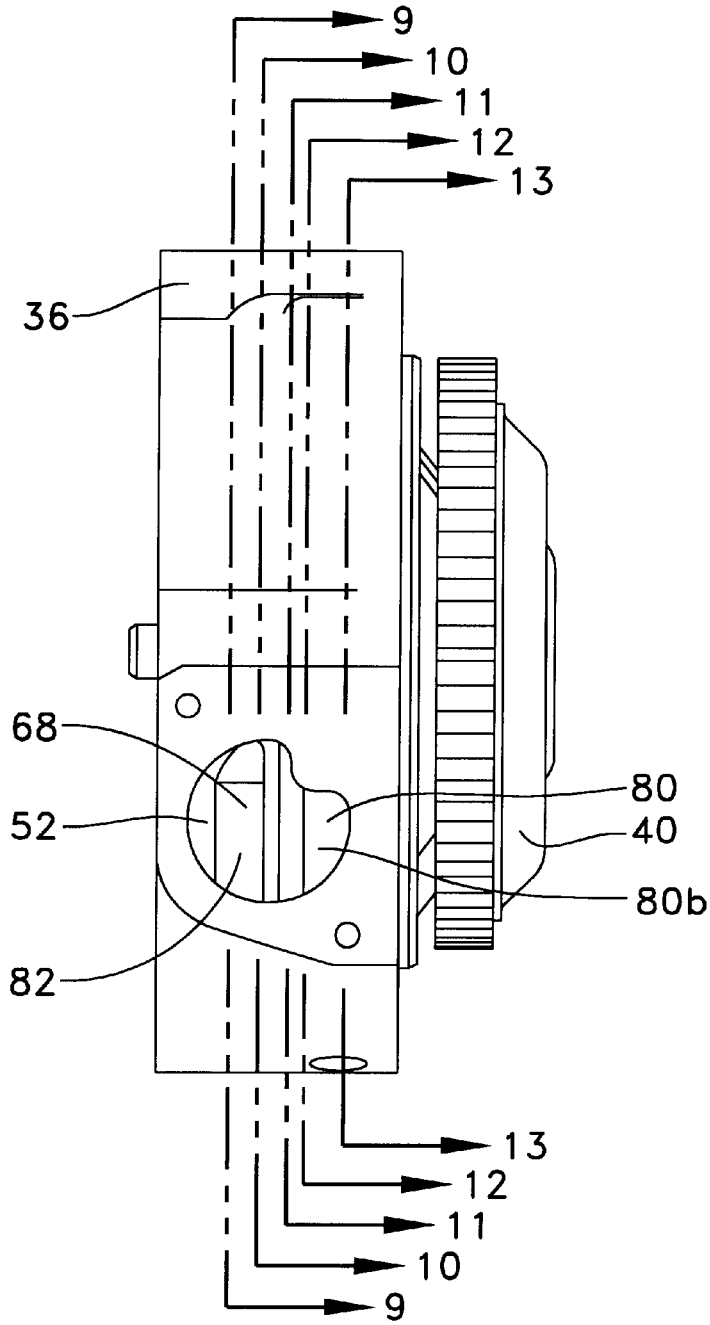
FIG. 8 is a side elevational view of the pump of FIG. 1 taken generally along the view lines 8—8 of FIG. 7.
Figure 9:
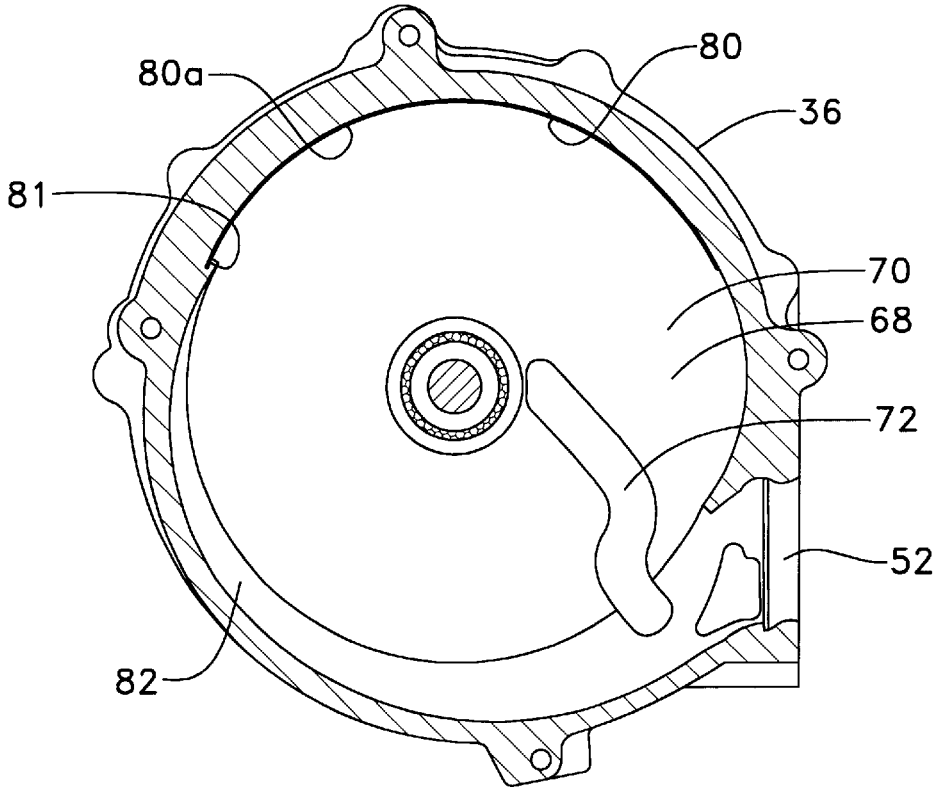
FIGS. 9–13 are sectional views taken generally along the lines 9—9, 10—10, 11—11, 12—12 and 13—13, respectively, of FIG. 8.
Figure 10:
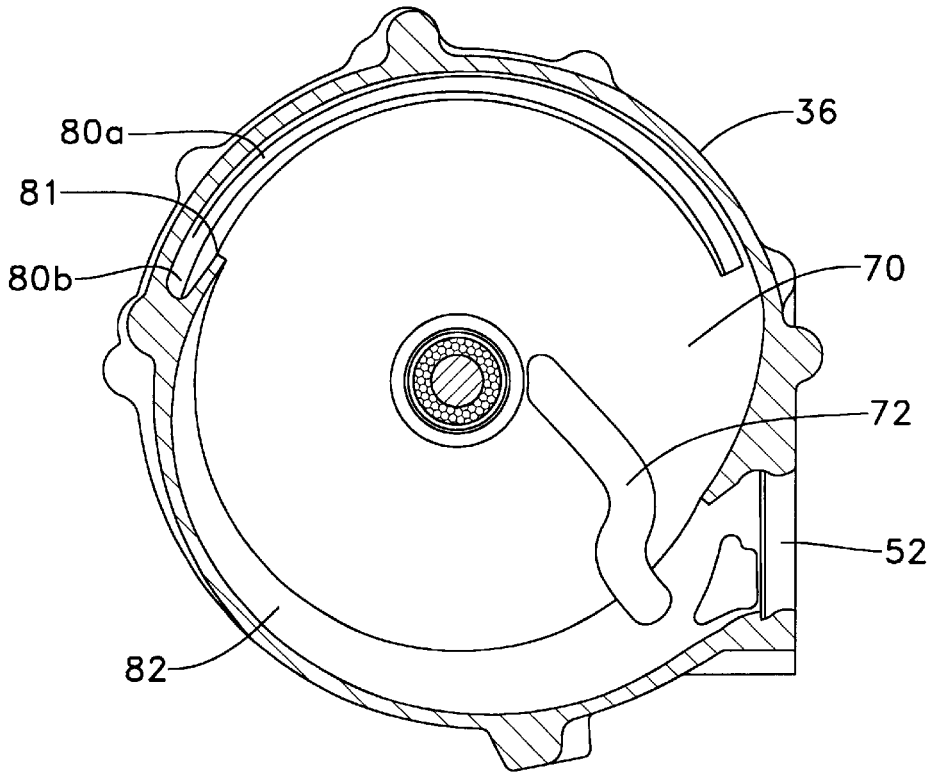
Figure 11:
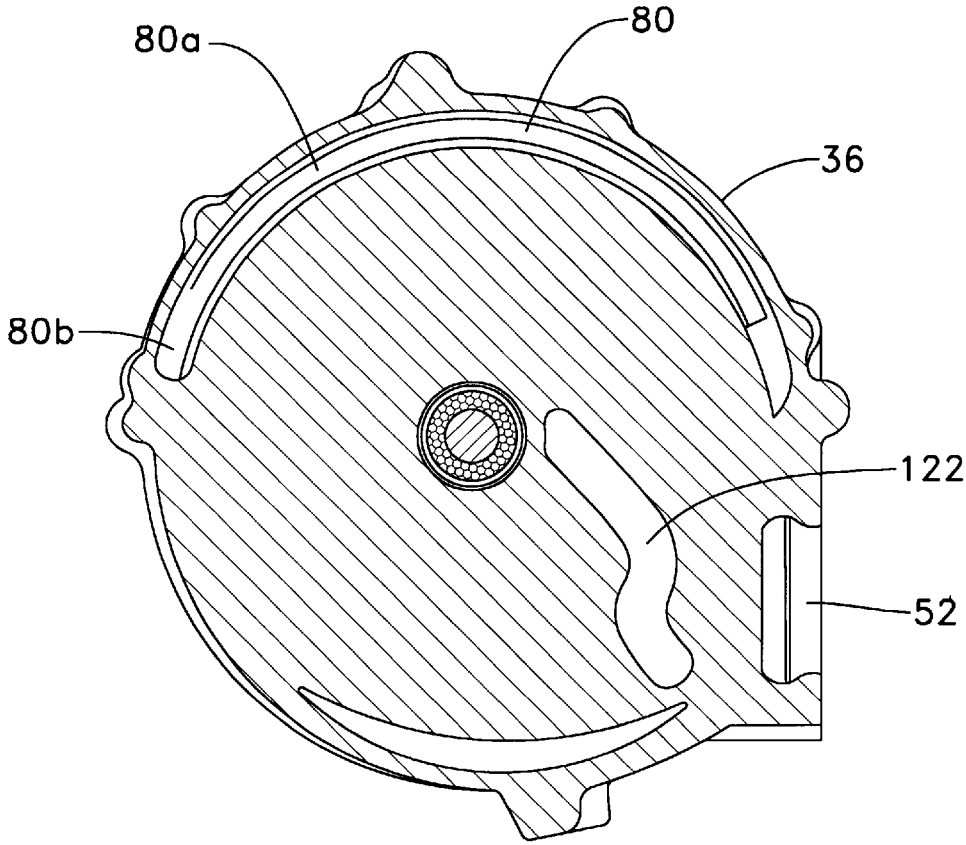
Figure 12:
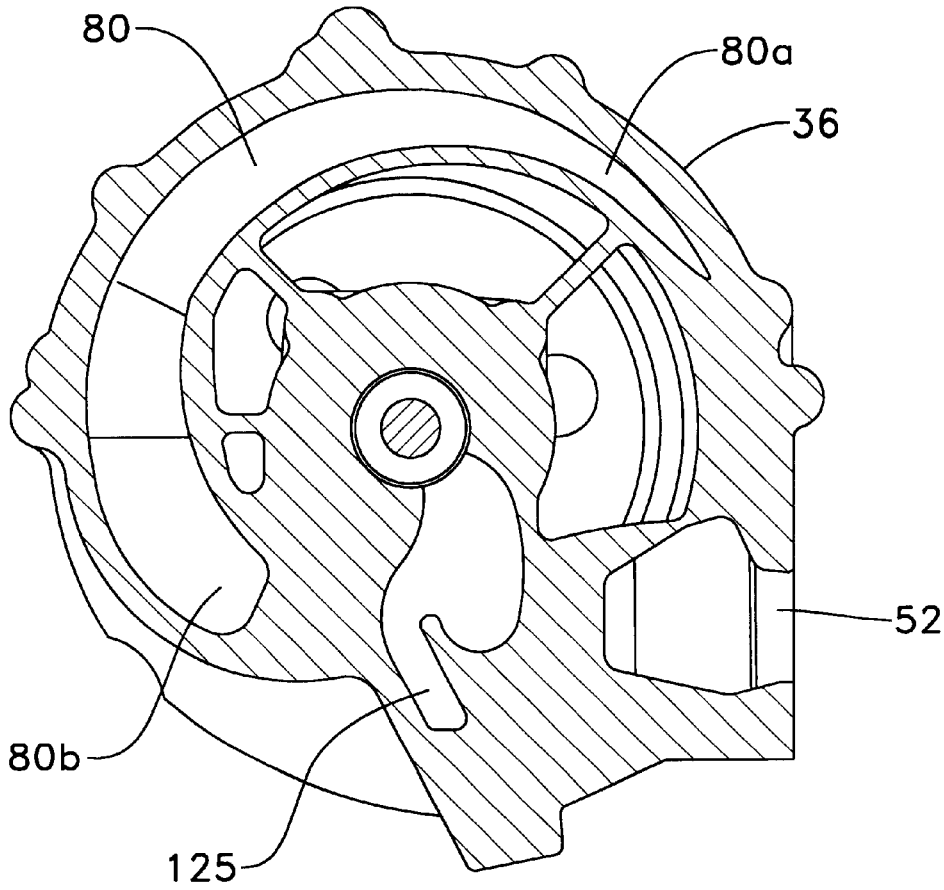

Referring specifically to FIGS. 3, 4 and 8, the pump 36 includes a main pump inlet 50, a bypass pump inlet 51 and a pump outlet 52. While not shown in the FIGS., the main pump inlet 50 is coupled to a radiator outlet and the bypass pump inlet is coupled to a bypass outlet of a bypass valve. The pump outlet 52 is coupled to an oil cooler 54 (FIGS. 1–4). A plurality of fluid ports 56 is provided on a rear intake cover 58 (FIGS. 1–4) of the pump 36 to allow heater hoses to be connected thereto. In the illustrated embodiment heater hoses are not connected to the pump, and hence, the fluid ports 56 are closed off by threaded plugs 59 (one of which is illustrated in FIG. 3).

Figure 5:
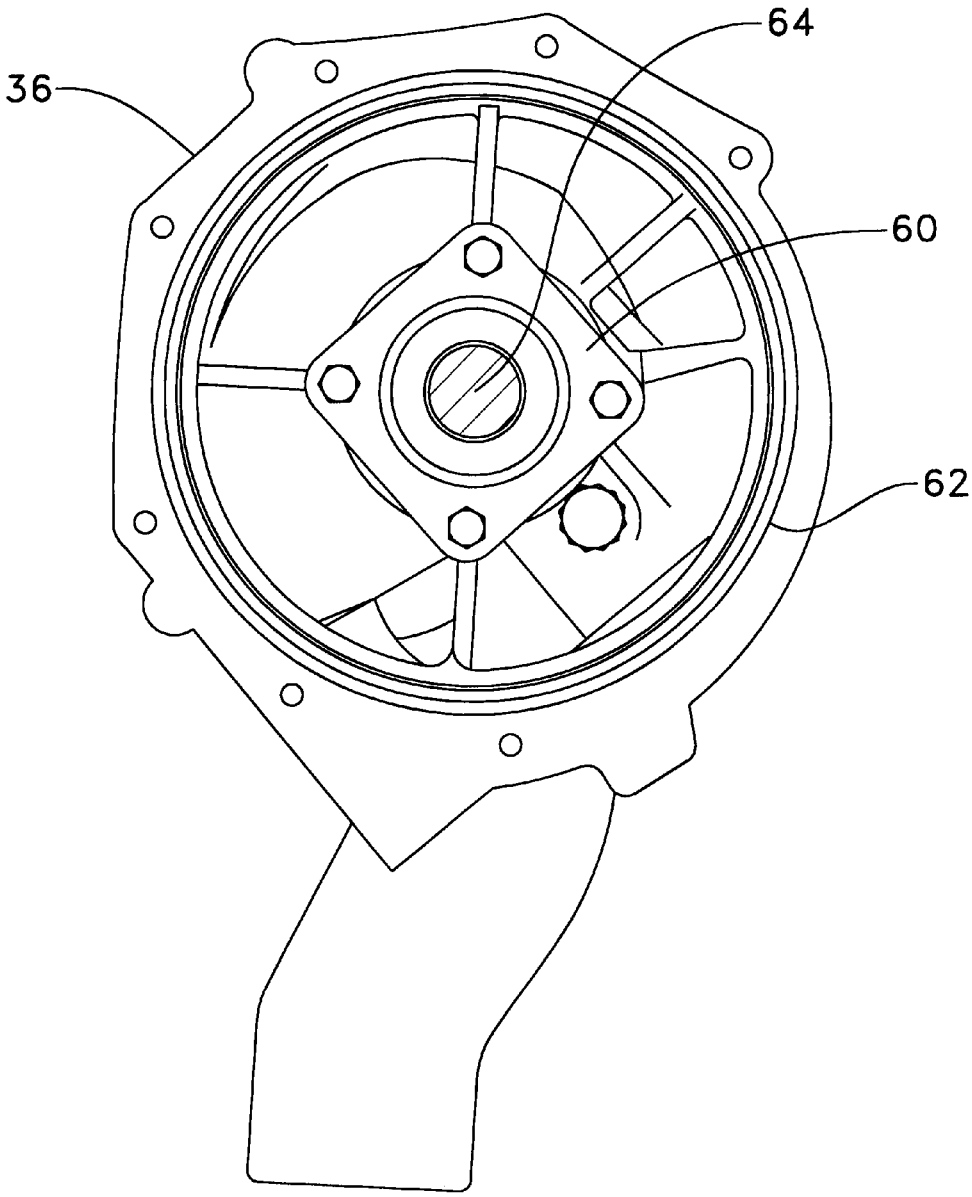
FIG. 5 is a front elevational view of the pump of FIG. 1.

Referring next to FIG. 5, the pump 36 is illustrated disassembled from the engine 30. A bearing retainer 60 is bolted or otherwise secured to a pump housing 62. The bearing retainer 60 retains bearings for a pump shaft 64 which is joined to the pump gear 40.

Figure 6:
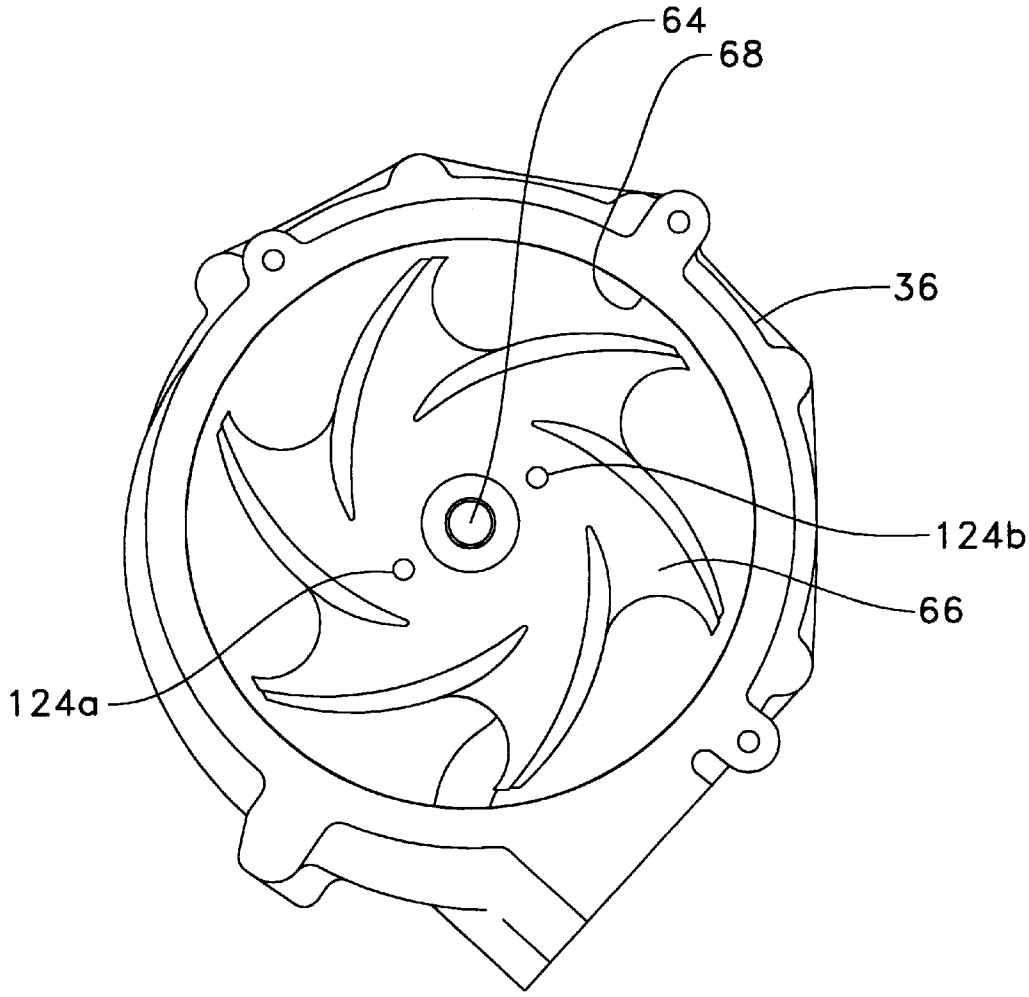
FIG. 6 is a rear elevational view of the pump of FIG. 1 with an intake cover removed to reveal an impeller disposed in an impeller recess.
Figure 7:
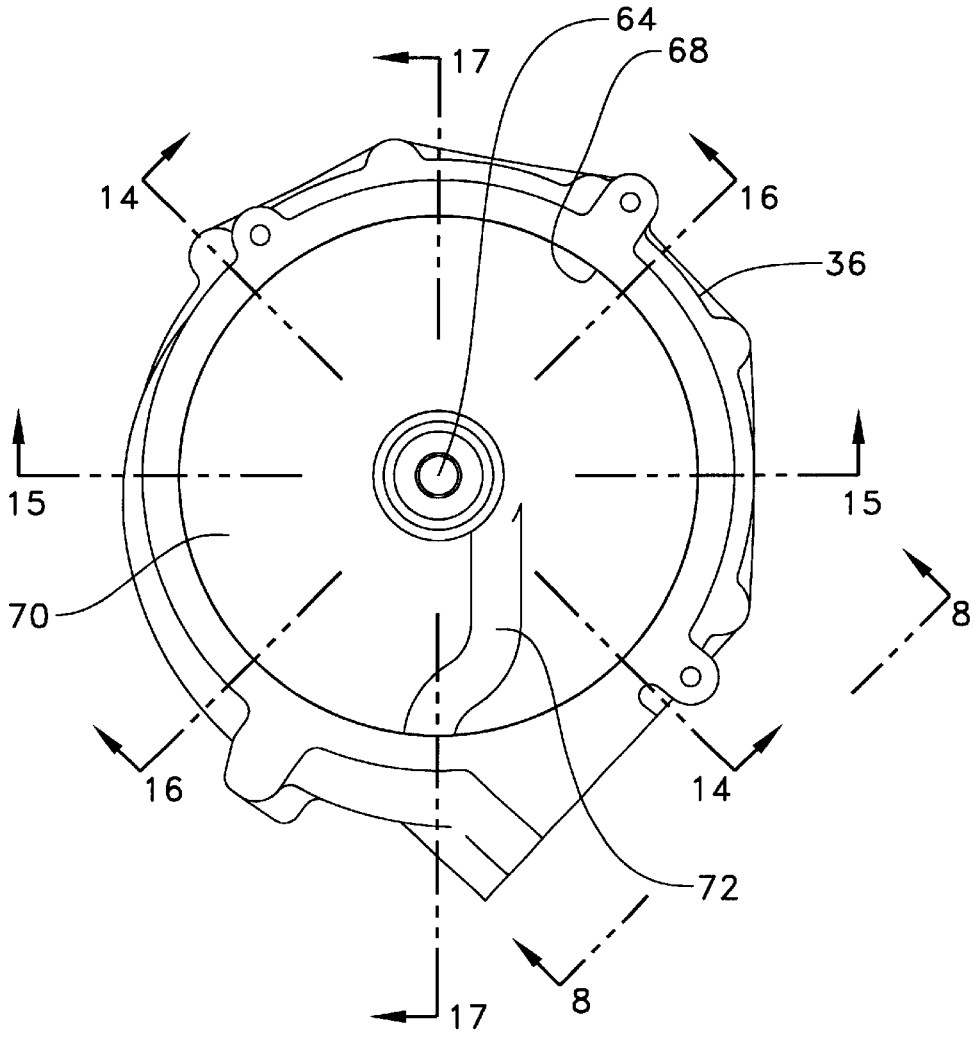
FIG. 7 is a rear elevational view similar to FIG. 6 with the pump impeller removed to reveal the impeller recess.

Referring to FIG. 6, a pump impeller 66 is disposed in an impeller cavity or recess 68 and is mounted on the pump shaft 64 for rotation therewith. Referring also to FIG. 7, the impeller cavity 68 is partially defined by a base surface 70 having a depressed portion 72 that overlies a passage described in greater detail hereinafter.

Referring next to FIGS. 7–17, the impeller cavity 68 is disposed in fluid communication with first and second volute passages 80, 82. Preferably, the first volute passage 80 is separate from the second volute passage 82. In addition, the first volute passage 80 includes a first portion 80*a* and a second portion 80*b* wherein the first portion 80*a* ends and the second portion 80*b* begins at a knife edge 81. Still further, as seen in FIGS. 8 and 14–17, the second portion 80*b* is preferably disposed substantially axially adjacent the second volute passage 82. Also preferably, each of the first passage portion 80*a* and the second volute passage 82 has a cross-sectional size that increases with circumferential distance toward a convergence passage 84 located in the pump housing 62 just upstream of the pump outlet 52. Preferably, the cross-sectional sizes of the passage portion 80*a* and the passage 82 continuously and linearly increase with circumferential distance toward the convergence passage 84 and the pump outlet 52. Still further in accordance with the preferred embodiment, the first volute passage 80 divides from the impeller cavity 68 at the knife edge 81, wherein the latter is disposed substantially diametrically opposite the outlet 52. Also, the cross-sectional size of the passage portion 80*b*, preferably remains substantially constant throughout the length thereof. The first volute passage 80 (specifically, the passage portion 80*b*) reconverges with the second volute passage 82 at the convergence passage 84.

Figure 20:
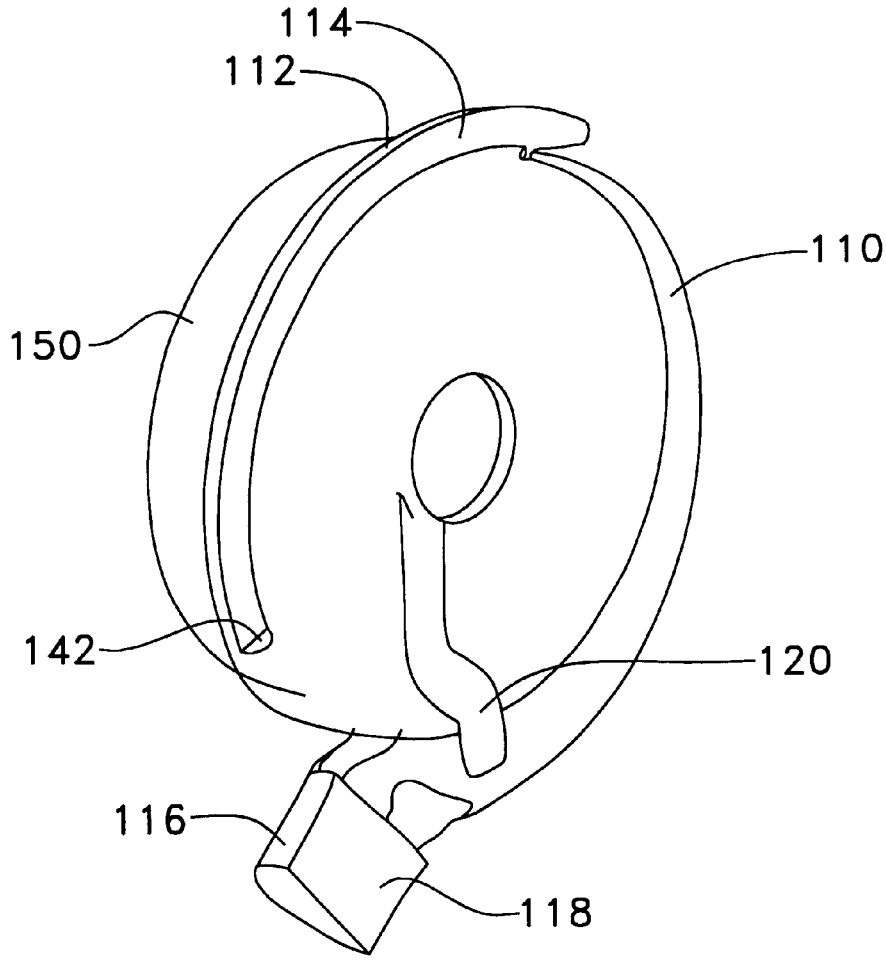
FIG. 20 is a trimetric view of one of the cores of FIGS. 18 and 19.

FIGS. 18–22 illustrate cores 100 and 102 that may be used to create the voids and passages in the pump housing 62. In particular, the core 100 includes a portion 110 that forms the second volute passage 82. As seen in FIG. 20, the core 100 further includes a portion 112 having a substantially flat face 114 and a portion 116 having a substantially flat face 118. Still further, the core 100 includes a raised portion 120 that creates a passage 122 (FIG. 11) underlying the depressed portion 72. The passage 122 is described in greater detail in U.S. Pat. No. 5,713,719, owned by the assignee of the present application and the disclosure of which is incorporated by reference herein. Specifically, the passage 122 permits cooling fluid to pass from the first volute passage 80 to the area of the seal for the pump shaft 64. The fluid flow then passes outwardly from the pump shaft seal through holes 124*a* and 124*b* (FIG. 6) back to the pump inlet 50.

Figure 13:
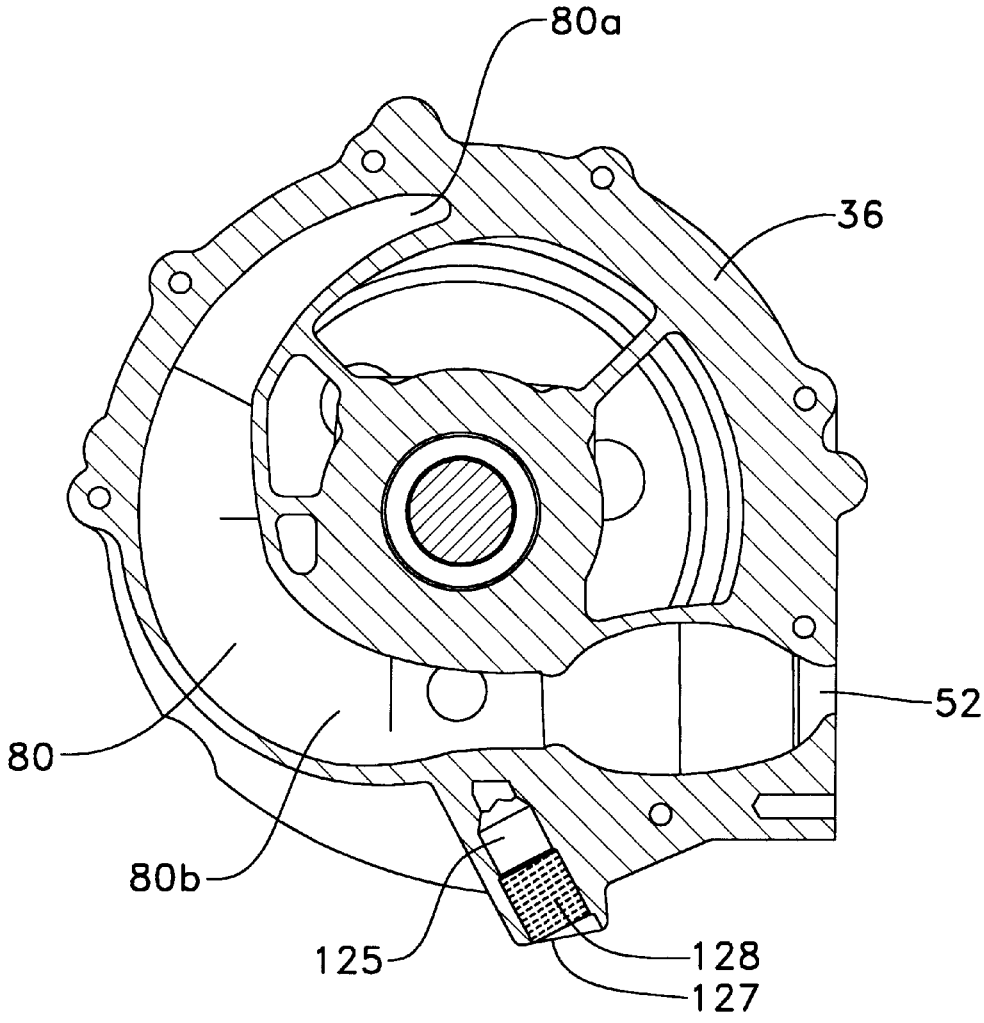
Figure 14:
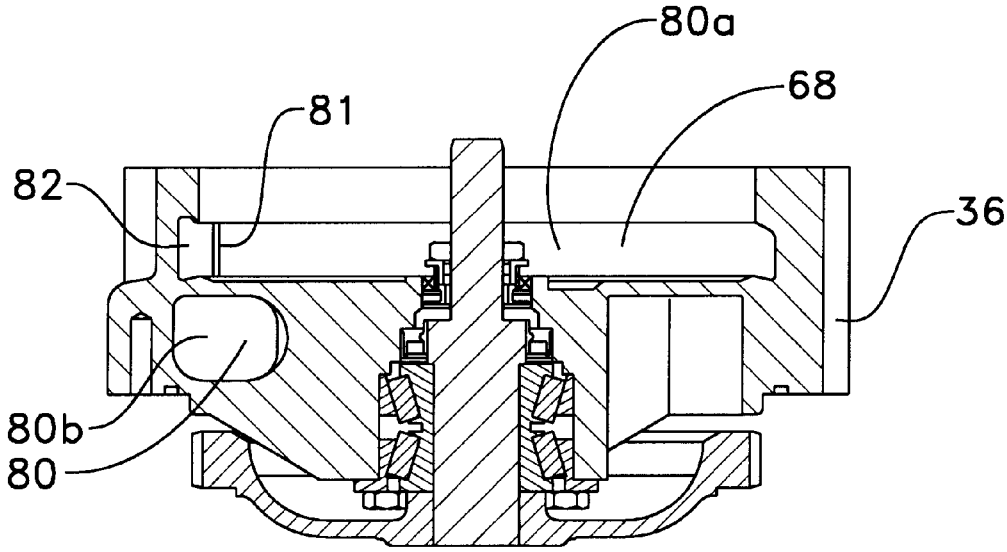
FIGS. 14–17 are sectional views taken generally along the lines 14—14, 15—15, 16—16 and 17—17, respectively, of FIG. 7.
Figure 15:
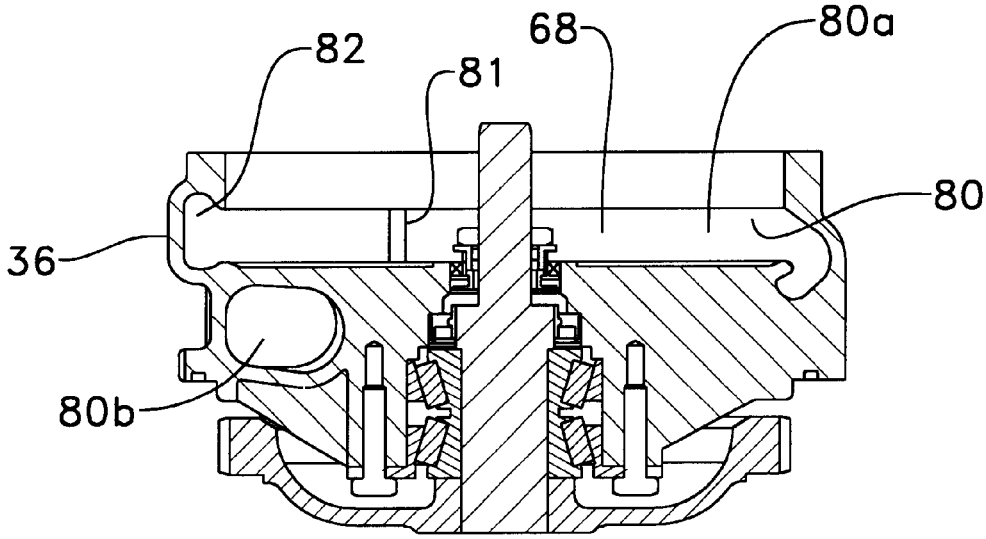
Figure 16:
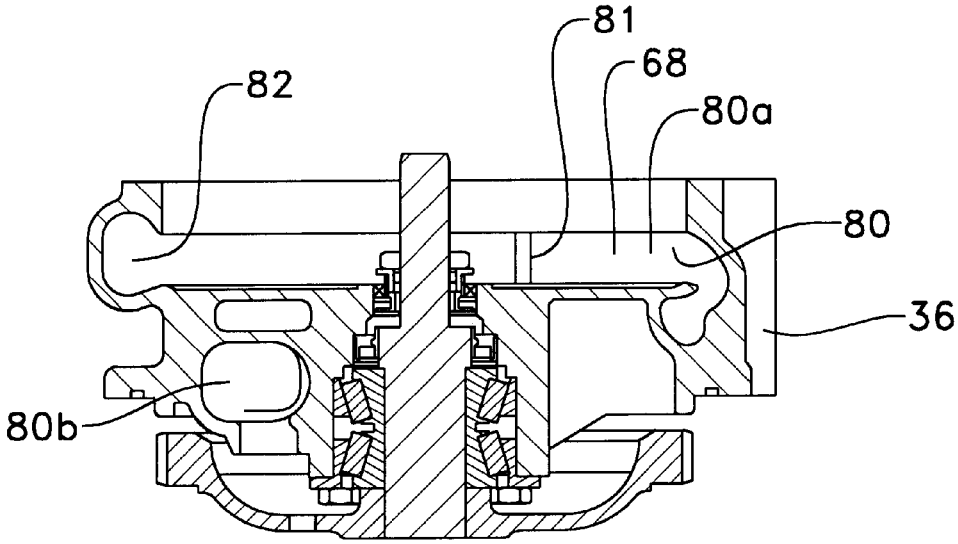
Figure 17:
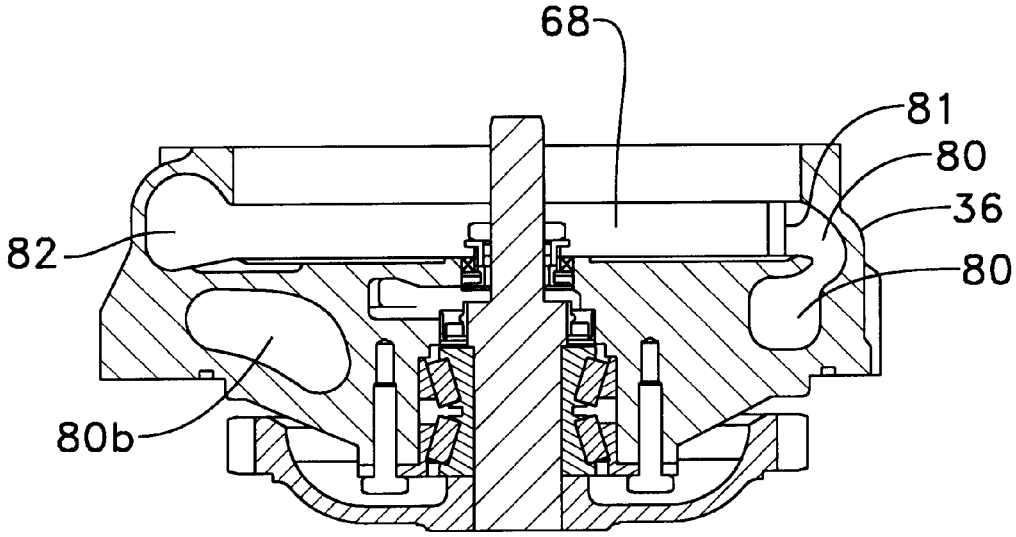
Figure 18:
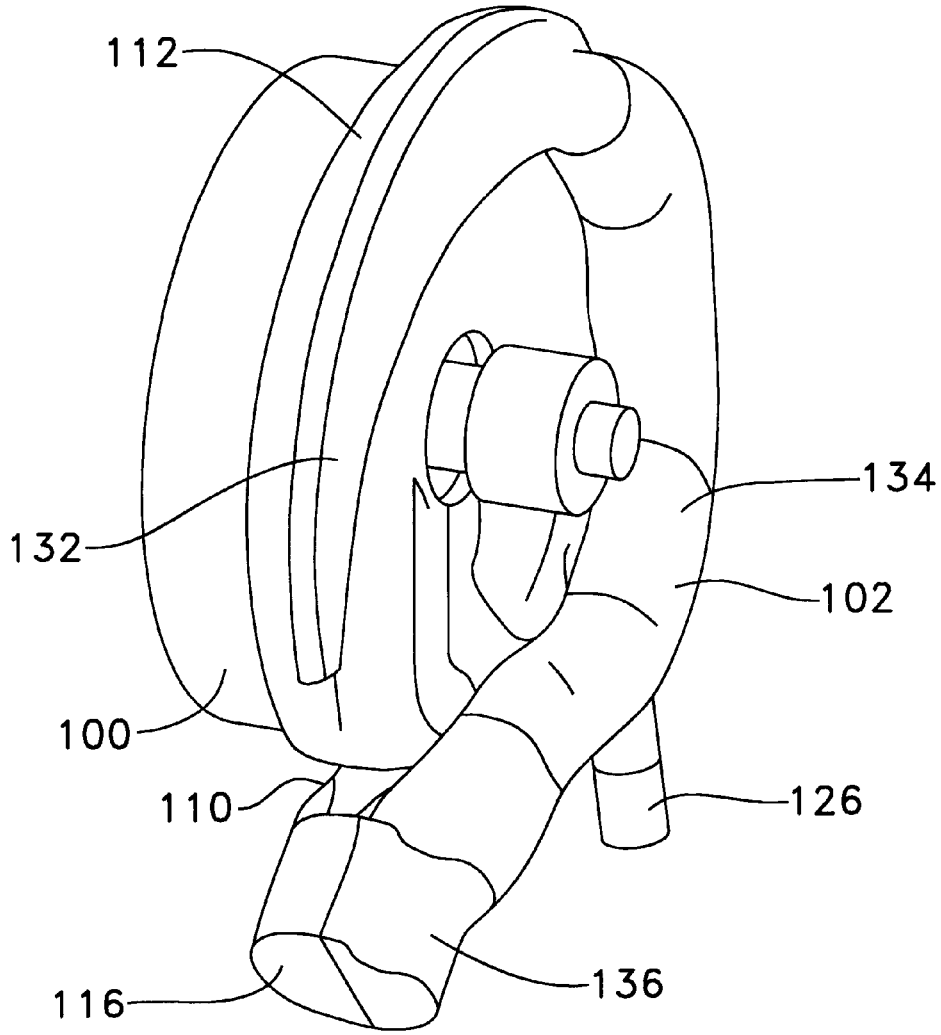
FIGS. 18 and 19 are trimetric front and rear views of assembled foundry cores for creating the recess and passages of the pump of FIGS. 1–17.
Figure 19:
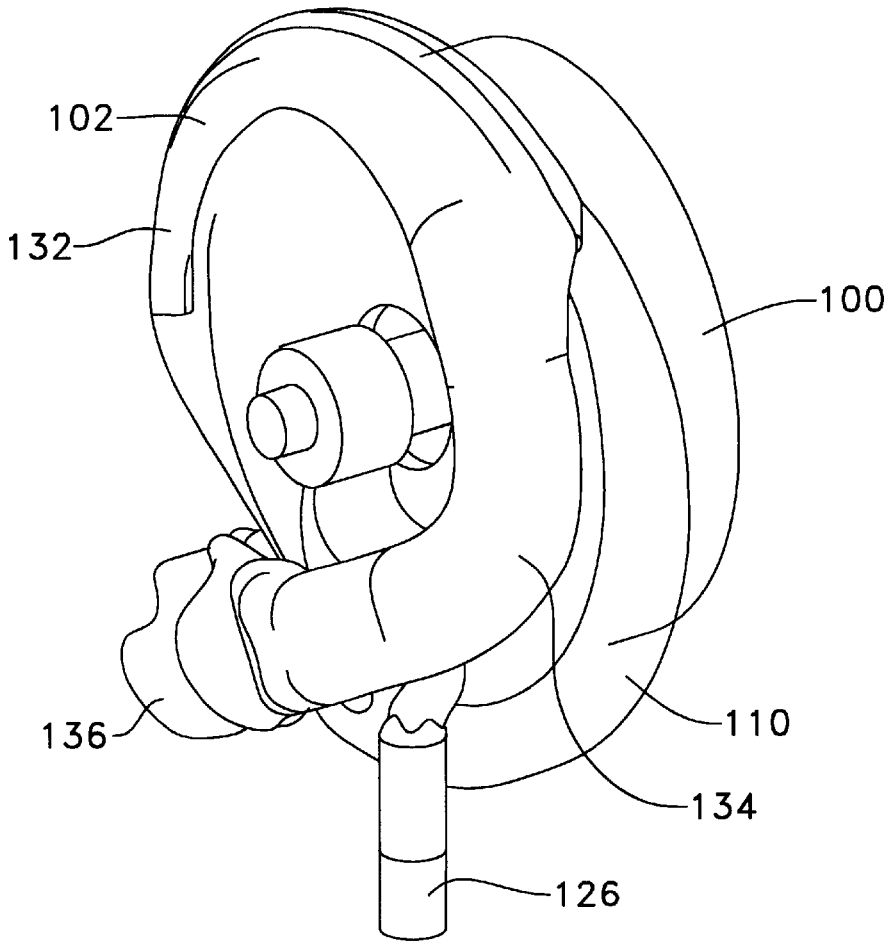

If desired, a further passage 125 created by a core portion 126 (FIGS. 18 and 19) may be provided extending between the pump shaft seal and a weep hole outlet 127 (FIG. 13). If desired, the weep hole outlet may be plugged by a porous insert 128 to prevent insects and/or debris from entering and/or obstructing the weep hole outlet 127. Also, the further passage 125 may be modified to create a sump well therein in accordance with the teachings of U.S. Pat. No. 5,490,762, also owned by the assignee of the present application and the disclosure of which is incorporated by reference herein.

Figure 21:
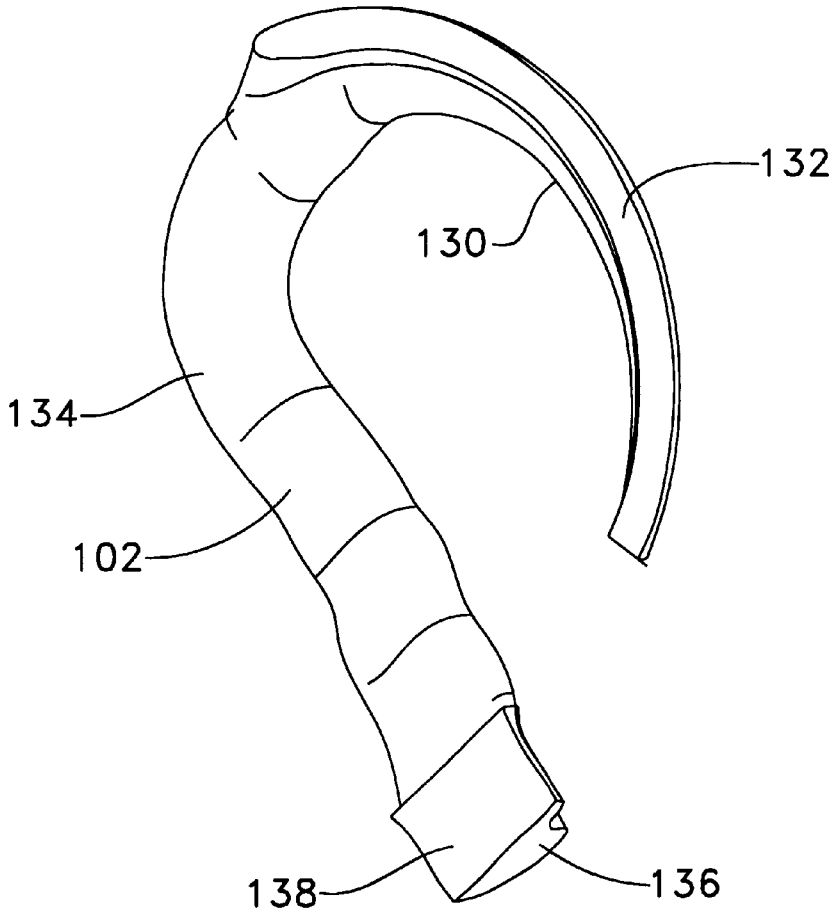
FIGS. 21 and 22 are trimetric views of opposite sides of another of the cores of FIGS. 18 and 19.
Figure 22:
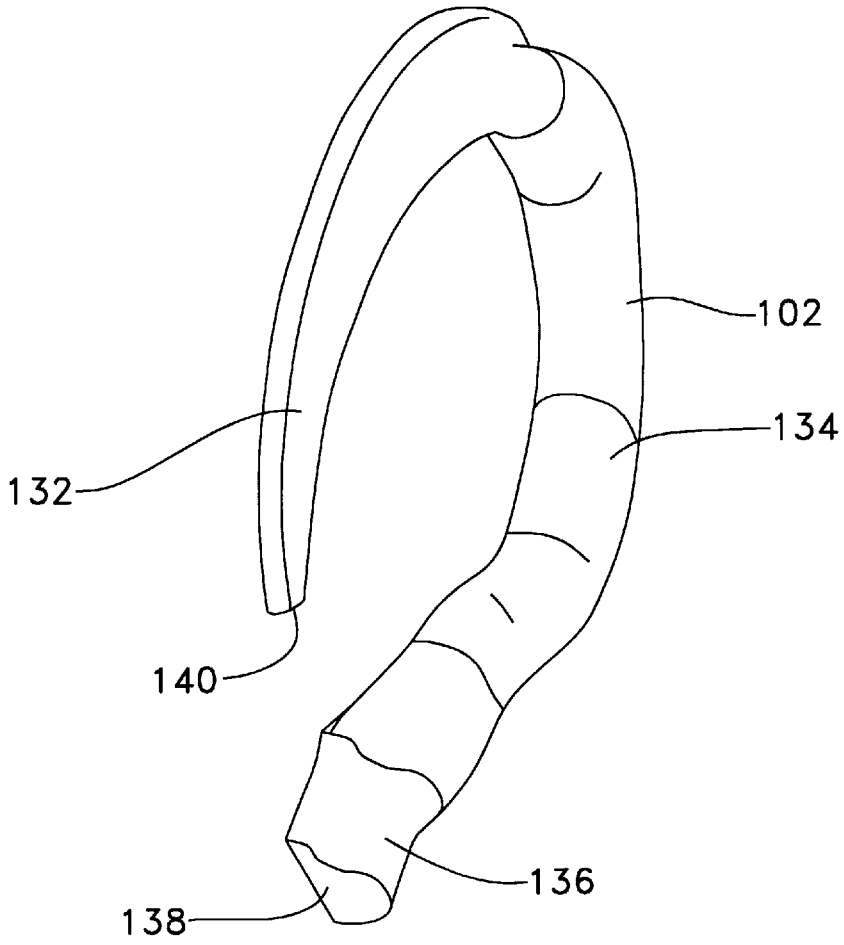

The core 102 includes a portion 130 having a substantially flat face 132 and further includes a main portion 134 and an end portion 136 having a substantially flat face 138 (FIGS. 21 and 22).

Before the casting operation, the cores 100 and 102 are secured together using any suitable method such that the faces 114 and 118 are joined to the faces 132 and 138, respectively, and so that a surface 140 abuts a surface 142. Thereafter, during the casting process, the portions 132 and 112 create the passage portion 80*a*. In addition, the portion 110 creates the second volute passage 80, the portion 134 creates the portion 80*b* of the first volute passage 80 and the portions 116 and 136 create the convergence passage 84.

Industrial Applicability

The pump 36 is operable when driven by the pump gear 40, in turn causing the impeller 66 to rotate and induce rotational movement (i.e., flow) of fluid in the impeller cavity 68. The fluid flow passes through the passage portion 80*a*, and thereafter splits and proceeds through the portion 80*b* of the first volute passage 80 and the second volute passage 82. The separate flows then rejoin one another at the convergence passage 84 and exit the pump 36 at the pump outlet 52.

By dividing the pump flow into axially-displaced passages 80, 82, the pump 36 can have an increased capacity, while at the same time still fit into the limited space available therefor. It should be noted that while the pump described herein may have a lower efficiency rating than conventional pumps, such a potential disadvantage is considered to be outweighed by the ability to provide a higher-capacity pump in a relatively small space.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

Other aspects and features of the present invention can be obtained from a study of the drawings, the disclosure, and the appended claims.

What is claimed is:

1. A pump, comprising:

a pump housing having an impeller recess therein and a pump outlet;

an impeller disposed in the impeller recess;

first and second separate volute passages disposed in the pump housing and disposed in fluid communication between the impeller recess and the pump outlet; and a convergence passage in fluid communication between the first and second separate volute passages and the convergence passage being positioned substantially at the pump outlet.

2. The pump of claim 1, wherein a portion of the first volute passage is adjacent the second volute passage in an axial direction.

3. The pump of claim 1, wherein the first volute passage divides from the impeller recess at a knife edge substantially diametrically opposed from the pump outlet.

4. The pump of claim 1, wherein portions of the first and second volute passages have cross-sectional sizes that increase toward the pump outlet.

5. The pump of claim 1, wherein a portion of the first volute passage and the second volute passage have cross-sectional sizes that continuously increase toward the pump outlet.

6. The pump of claim 1, wherein a portion of the first volute passage and the second volute passage have cross-sectional sizes that linearly and continuously increase toward the pump outlet.

7. An engine system, comprising:

an engine;

a pump operatively coupled to the engine, the pump including a housing having an impeller recess therein and a pump outlet;

an impeller disposed in the impeller recess;

first and second separate volute passages disposed in the pump housing and disposed in fluid communication between the impeller recess and the pump outlet; and a convergence passage in fluid communication between the first and second separate volute passages and the convergence passage being positioned substantially at the puma outlet.

8. The engine system of claim 7, wherein a portion of the first volute passage is adjacent the second volute passage in an axial direction.

9. The engine system of claim 7, wherein the first volute passage diverges from the impeller recess at a knife edge substantially diametrically opposed from the pump outlet.

10. The engine system of claims 7, wherein portions of the first and second volute passages have cross-sectional sizes that increase linearly toward the pump outlet.

11. The engine system of claim 7, wherein portions of the first and second volute passages have cross-sectional sizes that increase continuously and linearly toward the pump outlet.

12. A method of pumping fluid, the method comprising the steps of:

providing a pump having a housing wherein the pump housing includes an impeller recess having an impeller therein and a pump outlet;

supplying fluid to the impeller recess and motive power to the impeller thereby to induce fluid flow in the impeller recess;

dividing the fluid flow into first and second separate flows in the pump housing; and recombining the fluid flow in a convergence passage in the pump housing being positioned substantially at the pump outlet.

13. The method of claim 10, wherein the step of dividing includes the step of separating the fluid flows at a knife edge substantially diametrically opposed from the pump outlet.

14. The method of claim 11, wherein the step of dividing includes the step of providing first and second volute passages between the knife edge and the convergence passage.

15. The method of claim 12, wherein the step of providing the first and second volute passages includes the step of forming portions of each of the first and second volute passages with cross-sectional sizes that increase toward the pump outlet.

16. The method of claim 13, wherein the cross-sectional sizes of the portions of the first and second volute passages increase linearly toward the pump outlet.

17. The method of claim 13, wherein the cross-sectional sizes of the portions of the first and second volute passages increase continuously and linearly toward the pump outlet.

* * * * *